US006089172A

United States Patent [19]

Takenoya et al.

[11] Patent Number: 6,089,172

[45] Date of Patent: Jul. 18, 2000

[54] LOCK STITCH SEWING MACHINE WITH AUTOMATIC THREAD TENSION ADJUSTING DEVICE

[75] Inventors: Hideaki Takenoya; Yoshikazu Ebata; Akira Orii; Yoshitaka Takahashi; Eiji Murakami; Eiichi Shomura; Tsutomu Takagi; Yukio Hosaka, all of Hachioji, Japan

[73] Assignee: Janome Sewing Machine Co., Ltd., Tokyo, Japan

[21] Appl. No.: 09/374,672

[22] Filed: Aug. 16, 1999

[30] Foreign Application Priority Data

Sep. 22, 1998 [JP] Japan ..... 10-284754

[51] Int. Cl.[7] ..... D05B 19/12; D05B 47/04

[52] U.S. Cl. ..... 112/470.04; 112/254

[58] Field of Search ..... 112/470.01, 470.04, 112/254, 255, 237; 242/150 R, 150 M

[56] References Cited

U.S. PATENT DOCUMENTS 4,289,087 9/1981 Takenoya et al. ..... 112/254
4,803,936 2/1989 Mikuni et al. ..... 112/254

*Primary Examiner*—Peter Nerbun
*Attorney, Agent, or Firm*—Nields, Lemack & Dingman

[57] ABSTRACT

A lock stitch sewing machine with an automatic thread tension adjusting device is disclosed, wherein the sewing machine has a plurality of thread tension adjusting mechanisms 7, each of which including a pair of thread tension disks 12, 13, one of which is normally pressed by a spring toward the other. A sensor 4 is responsive to the operation of a thread tension releasing lever 20 made by a user with a slight touch applied thereto to give a signal. A CPU1 is responsive to the signal to compare the value of the existing thread tension of the thread tension adjusting mechanisms 7 with a predetermined one. If the value of the existing thread tension is higher than the predetermined one, the CPU1 is operated reduce the value of the existing thread tension to a predetermined one. Thus the tension releasing operation ability is increased.

4 Claims, 4 Drawing Sheets

LOCK STITCH SEWING MACHINE WITH AUTOMATIC THREAD TENSION ADJUSTING DEVICE

BACKGROUND OF THE INVENTION AND RELATED ART STATEMENT

1. Field of the Invention

The invention relates to a lock stitch sewing machine, and more particularly relates to an automatic thread tension adjusting device of the lock stitch sewing machine.

2. Prior Art

It is generally known that a lock stitch sewing machine has a plurality of thread tension adjusting mechanisms, each of which including a pair of disks which are adjustably pressed against each other by means of a compression spring to give the thread an optional tension in dependence upon the work to be stitched, the thread tension being automatically adjusted by means of actuators including motors, the rotation of which is controlled by a control device. On the other hand, the lock stitch sewing machine has a device which is manually operated to release the thread tension disks. However, it requires a considerably great force to operate the thread tension releasing device to release the thread tension disks at a time against the total spring action of so many compression springs especially when the thread tension is set high with the compression springs strongly compressed. This detracts from the operation ability of the sewing machine when the user operates the thread tension releasing device to release the thread tension.

OBJECTS OF THE INVENTION

The invention has been provided to eliminate the defects and disadvantages of the prior art. It is, therefore, a principal object of the invention to provide a lock stitch sewing machine with an automatic thread adjusting device including a plurality of thread tension adjusting mechanisms which may be released with a slight touch by a user at a tension releasing lever.

It is another object of the invention to provide mechanically compact and operatively reliable thread tension adjusting mechanisms adapted to substantially automatically operate in response to a slight touch by a user.

SUMMARY OF THE INVENTION

In short, the invention substantially comprises a plurality of thread tension adjusting mechanisms, each of which including a pair of thread tension disks, one of which is normally pressed by a spring toward the other, a thread tension input means including a knob manually operated to enter an optional value of thread tension, an actuator including a motor operated to press one of said thread tension disks in the directions to and away from the other to give an optional thread tension, a thread tension releasing means including a releasing lever manually operated to release the thread tension of the thread tension adjusting mechanisms, a sensor means for detecting the operation of the thread tension releasing means, and a control means operated in response to the operation of the thread tension releasing means detected by said sensor means to operate the actuator to operate the thread tension means to decrease the value of the existing thread tension to a value lower than a predetermined value.

DETAILED DESCRIPTION OF THE PREFERRED EMBODIMENTS

The invention will now be described in reference to the attached drawings.

Figure 1:
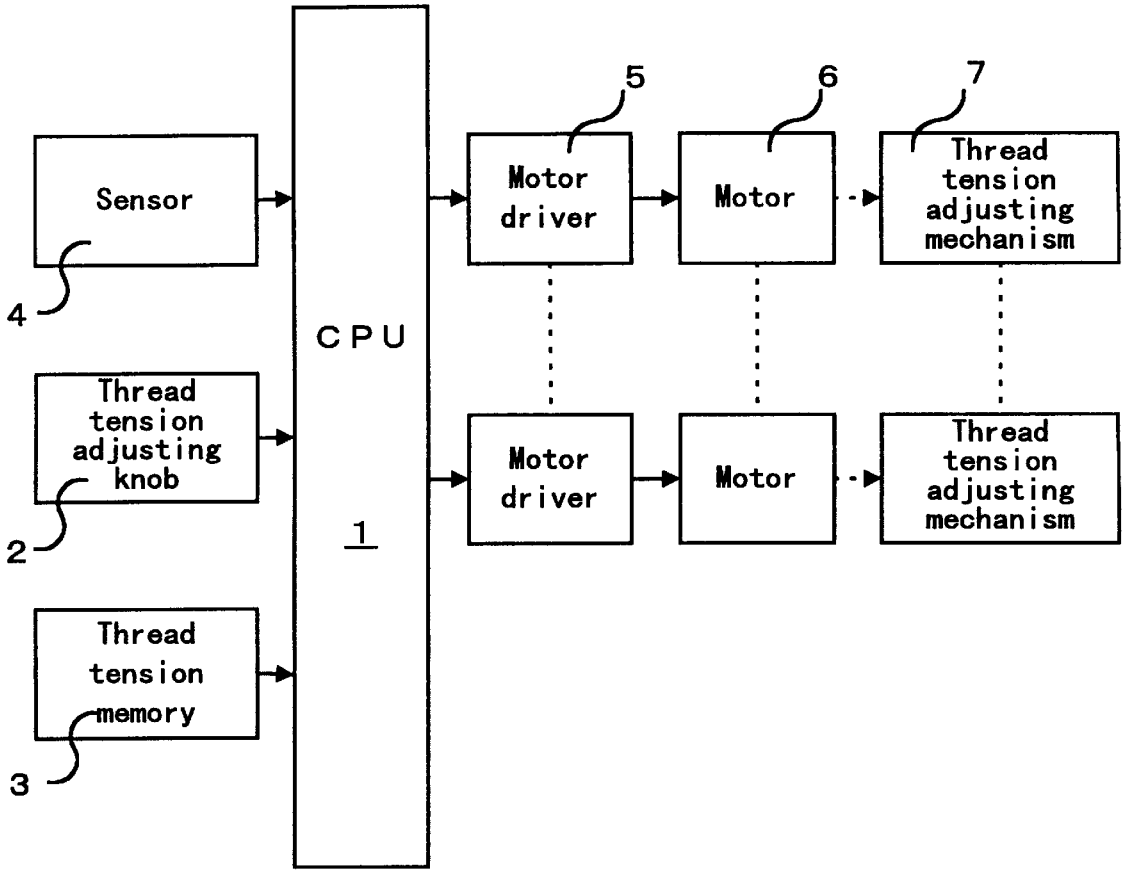
FIG. 1 is a block diagram showing an overall function of the invention.

In FIG. 1, a thread tension adjusting mechanism 7 is operated to set an optional thread tension by a motor 6 which is connected to CPU1 through a motor driver 5 to be controlled thereby.

A thread tension adjusting knob 2 is provided on a lock stitch sewing machine and is operated by a user to give an electric signal to the CPU1 which is operated in response to the signal to control the rotation of the motor 6 through the motor driver 5, thereby to set an optional thread tension in the thread tension adjusting mechanism 7. The set thread tension is stored in a thread tension memory 3.

A sensor 4 is provided to detect the operation of a releasing lever 20 as it is operated, the releasing lever 20 being provided on a lock stitch sewing machine as will be described in detail hereinafter. The operation signal detected by the sensor 4 is given to the CPU1.

Upon receiving the operation signal from the sensor 4, the CPU1 is operated to discriminate if the value of the thread tension set to the thread tension adjusting mechanism 7 is higher than a predetermined value of thread tension. If the set value is higher than the predetermined one, the CPU1 is operated to control the motor 6 to decrease the thread tension of the thread tension adjusting mechanism 7. Thus a slight operation of the releasing lever 20 made by the user is enough to release the thread tension of the thread tension adjusting mechanism 7, even if a plurality of thread tension adjusting mechanisms are provided.

Figure 2:
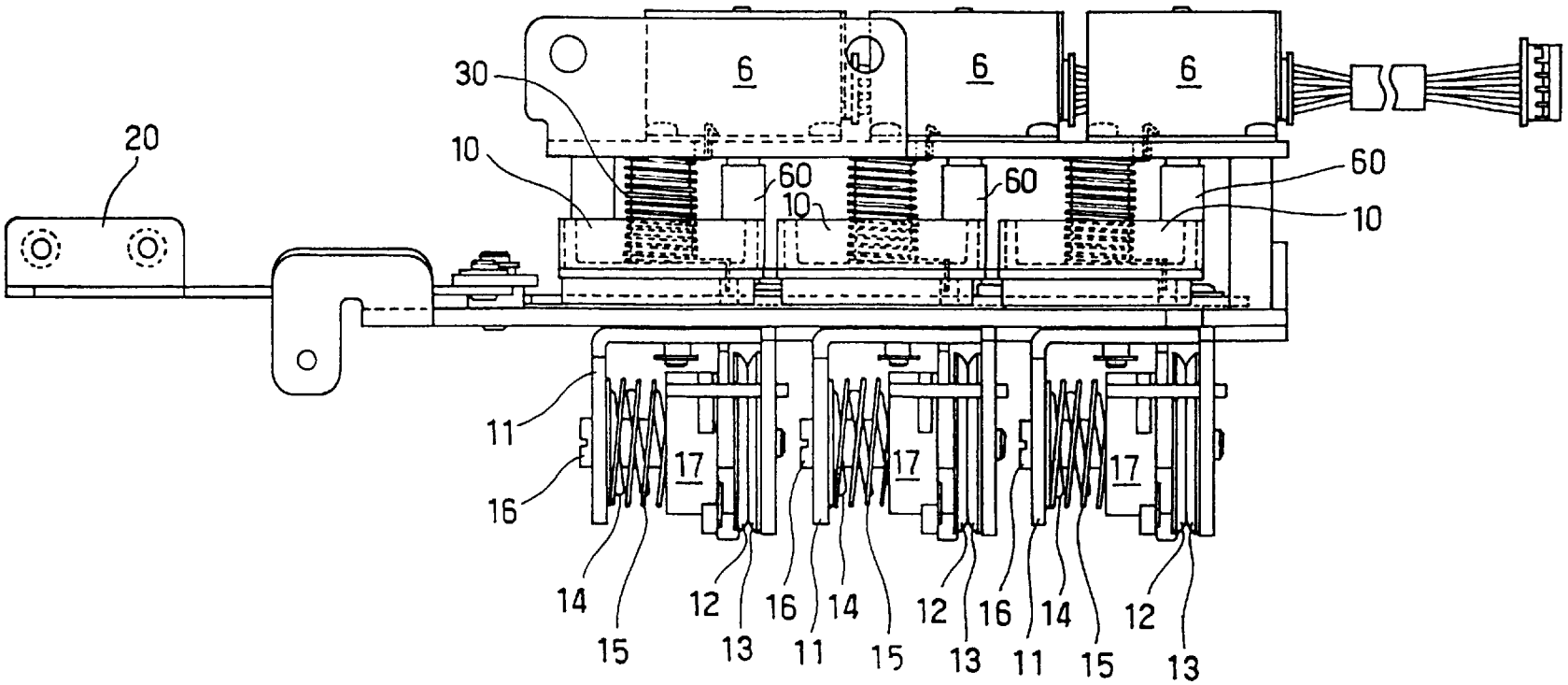
FIG. 2 is a plan elevational view of the mechanism according to the invention.
Figure 3:
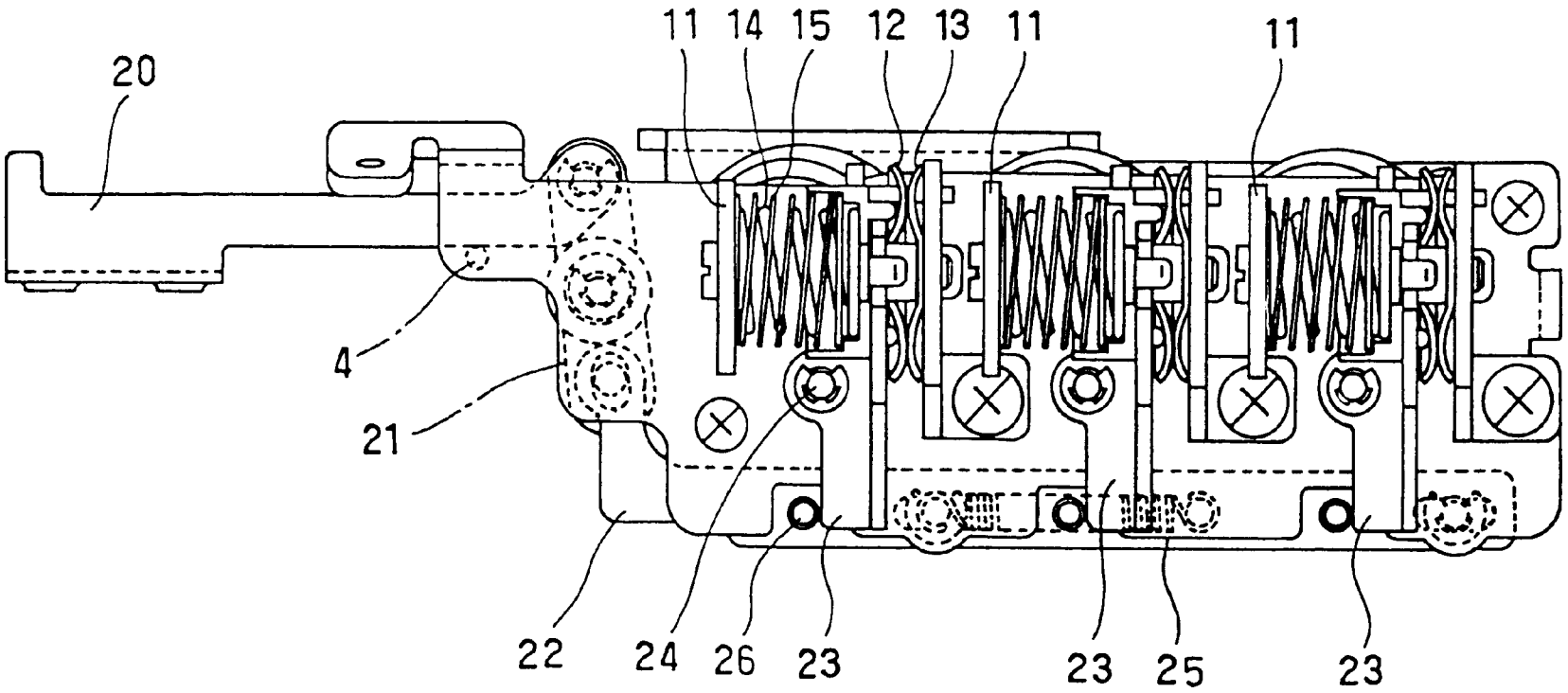
FIG. 3 is a front elevational view of the mechanism according to the invention.

In FIGS. 2 and 3, there are shown three thread tension adjusting mechanisms 7 by way of example which are arranged laterally in alignment with each other each of which is provided with the motor 6. The motor 6 has a gear 60 which is in engagement with a thread tension cam 10. Thus the thread tension cam 10 is rotated by the motor 6 to laterally slide a thread tension adjusting plate 11, since the thread tension cam 10 has a lead groove formed thereat which is in engagement with a pin fixed to the thread tension adjusting plate 11. Due to the rotation of the thread tension cam 10, the thread tension adjusting plate 11 is slidingly moved in one direction to compress a compression spring 14 while the compression spring 14 presses one 12 of the thread tension disks 12,13 against the other 13, thereby to increase the thread tension of each thread tension adjusting unit of the thread tension adjusting mechanism 7. The thread tension adjusting plate 11 is moved in the opposite direction to decrease the thread tension. The thread tension adjusting plate 11, the compression spring 14 and the thread tension disks 12,13 are supported on a support bar 16.

In FIG. 3, the releasing lever 20 is vertically rotatable. When the releasing lever 20 is pressed down, a link 21 having an upper end operatively connected to the releasing lever 20 may be rotated in the counterclockwise direction. Then a plate 22 having one end operatively connected to a lower end of link 21 may be moved to rightward. Then a pin 26 fixed to the plate 22 and engaging a lower end of a releasing plate 23 in each thread tension adjusting mechanism 7 may turn the releasing plate 23 in the counterclockwise direction around an axis 24. Then the releasing plate 23 having an upper end operatively connected to the thread tension disk 12 may move the thread tension disk 12 in the direction away from the thread tension disk 13 against the spring action of the compression spring 14, thereby to release the thread tension disk 12 from the thread.

The sensor 4 is arranged at a position in which the sensor 4 directly and immediately detects the downward movement of the releasing lever 20. In this embodiment, the sensor 4 is arranged closely adjacent the lower side of the releasing lever 20 such that only a slight movement of the releasing lever may be detected by the sensor 4.

Upon receiving the operation signal of the releasing lever 20 detected by the sensor 4, the CPU1 is operated to read the previously set value of the thread tension out of the thread tension memory 3 and compares the value with a predetermined value to discriminate if the read out value is higher than the predetermined value. If the set value is higher than the predetermined one, the CPU1 is operated to drive the motor 6 of each thread tension adjusting mechanism 7 to move the thread tension adjusting plate 11 in the leftward direction so that the spring force of the compression spring 14 applied to the thread tension disk 12 may be decreased. This will enable the machine user only to touch the thread releasing lever 20 in order to release the thread tension of each thread tension adjusting mechanism 7. Thus the operation ability of the thread tension adjusting mechanism 7 is remarkably increased.

Further according to the invention, each thread tension adjusting mechanism 7 has a supplementary spring 15 coaxially arranged with the thread tension spring 14 and exerting a force in the direction for expanding the compression spring 14. Further each thread tension adjusting mechanism 7 has a torsion coil spring 30 provided around a rotational axis of the thread tension cam 10 and exerting a force in the direction for moving the thread tension adjusting plate 11 so that the spring force of the compression spring 14 applied to the thread tension disk 12 may be decreased. The supplementary spring 15 and the torsion coil spring 30 will together provide a force to help the motor 6 to release the thread tension of the thread tension adjusting mechanism 7. This will reduce the maximum output of the motor 6 resulting in a design of a small sized motor.

Figure 4:
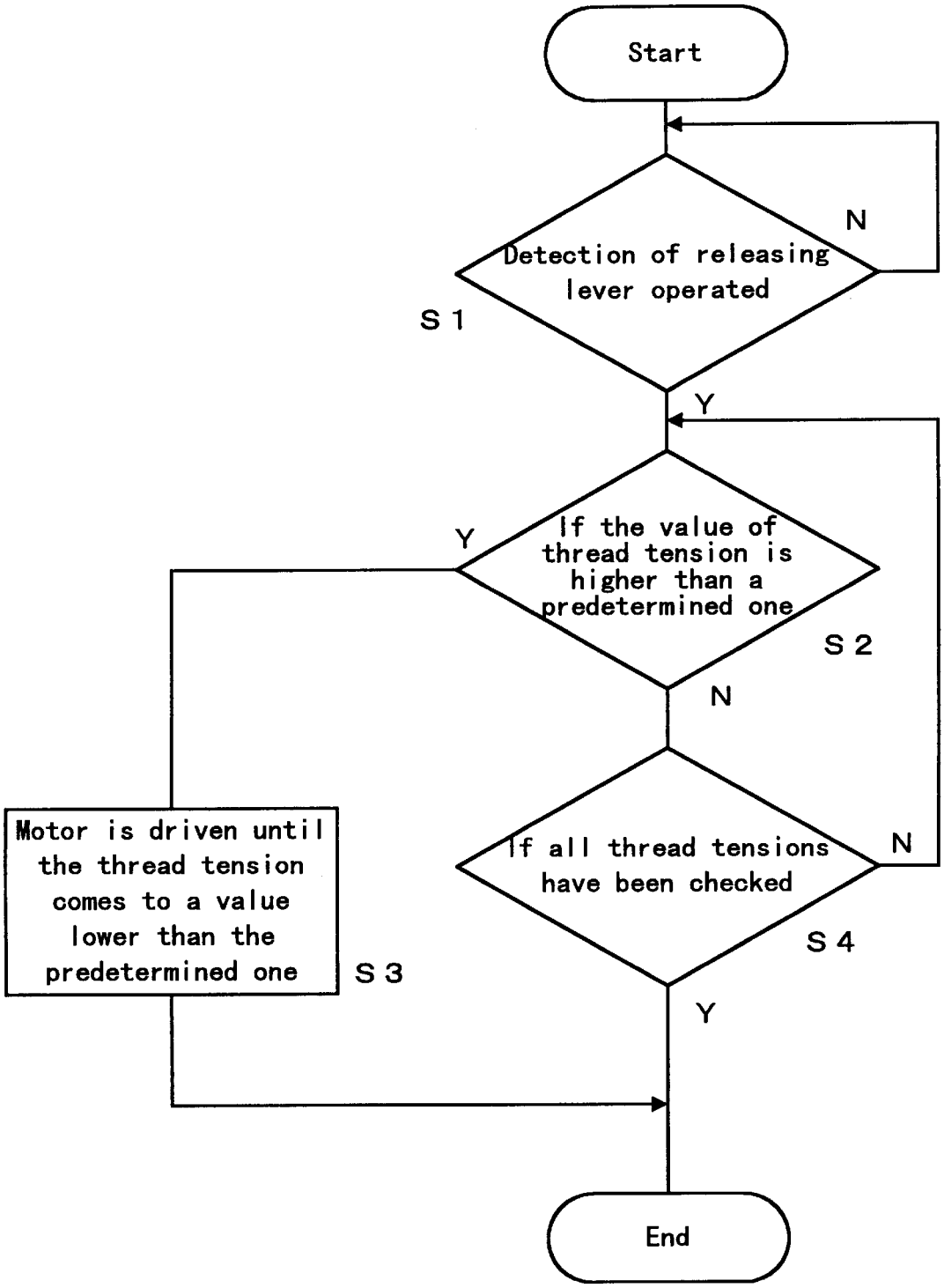
FIG. 4 is a flow chart showing the operations of the invention.

FIG. 4 shows the operations of the invention. When the releasing lever 20 is operated, that is, pressed down with a slight force applied thereto, the slight movement of the releasing lever 20 is detected by the sensor 4. The signal detected by the sensor 4 is given to the CPU1 (step Si). Then the CPU1 is operated to read the previously set value of thread tension out of the thread tension memory 3 and compare the set value with a predetermined value to discriminate if the set value is higher than the predetermined value (step S2). If the set value is higher than the predetermined value, the CPU1 is operated to control the motor 6 to decrease the thread tension of each thread tension adjusting mechanism 7 (step S3). If the previously set value of thread tension is not more than the predetermined one, discrimination is made if all of the thread tension adjusting mechanisms 7 have been checked (step S4). If so checked, the CPU1 remains inoperative to leave each thread tension adjusting mechanism 7 as it is.

As described above, according to the invention, a slight touching force applied to the releasing lever 20 by the user will substantially automatically release the thread tension of each of plural thread tension adjusting mechanisms 7. Thus the ability of the thread tension releasing operation is remarkably increased giving the user a light and stabilized sense of thread tension releasing operation.

The entire disclosure of Japanese Patent Application No.10-284754 filed on Sep. 22, 1998, including specification, claims, drawings and summary is incorporated therein by reference in its entirety.

The invention being thus described, it will apparent that the same may be varied in many ways. Such variations are not regarded as a departure from the spirit and scope of the invention, and all such modifications are intended to be included within the scope of the following claims.

What is claimed is:

1. A lock stitch sewing machine with an automatic thread tension adjusting device having a plurality of thread tension adjusting mechanisms, each of which including a pair of thread tension disks, one of which is normally pressed by a spring toward the other, said sewing machine substantially comprising:

a thread tension input means including a knob manually operated to enter an optional value of thread tension;

an actuator including a motor operated to press one of said thread tension disks in the directions to and away from the other to give an optional thread tension;

a thread tension releasing means including a releasing lever manually operated to release the thread tension of said thread tension adjusting mechanisms;

a sensor means for detecting the operation of said thread tension releasing means; and a control means operated in response to the operation of said thread tension releasing means detected by said sensor means to operate said actuator to operate said thread tension means to decrease the value of the existing thread tension to a value lower than a predetermined value.

2. The lock stitch sewing machine as defined in claim 1, wherein each of said thread tension adjusting mechanism includes a spring normally exerting a force in a direction opposite to a direction of applying a force to said one of said thread tension disks, thereby to reduce a load of said actuator when said actuator is operated to decrease the existing thread tension to a value lower than a predetermined value.

3. A lock stitch sewing machine with an automatic thread tension adjusting device having a plurality of thread tension adjusting mechanisms, each of which including a pair of thread tension disks, one of which is normally pressed by a spring toward the other, said sewing machine substantially comprising:

a thread tension input means including a knob manually operated to enter an optional value of thread tension;

a memory means for storing therein the value of thread tension entered by said thread tension input means;

a thread tension releasing means including a releasing lever manually operated to release the thread tension of each of the thread tension adjusting mechanisms;

a sensor means for detecting the operation of said thread tension releasing means; and a control means operated in response to the operation of said thread tension releasing means detected by said sensor means to read out said thread tension value stored in said memory means and compare the value with a predetermined value to discriminate if said thread tension value is higher than said predetermined value, said control means being operated to give a control signal commanding to make said thread tension value to a value lower than said predetermined value when said thread tension value is higher than said predetermined value; and an actuator including a motor operated in response to said control signal to operate each thread tension adjusting mechanism to release the thread tension thereof.

4. The lock stitch sewing machine as defined in claim 3, wherein each of said thread tension adjusting mechanism includes a spring normally exerting a force in a direction opposite to a direction of applying a force to said one of said thread tension disks, thereby to reduce a load of said actuator when said actuator is operated to decrease the existing thread tension to a value lower than a predetermined value.

* * * * *